US006742653B2

(12) United States Patent
Kao

(10) Patent No.: US 6,742,653 B2
(45) Date of Patent: Jun. 1, 2004

(54) TOOL SUSPENSION DEVICE

(76) Inventor: Jui-Chien Kao, No. 358, Tunghsing Rd., Shuwang Li, Tali City, Taichung Hsien (TW)

( * ) Notice: Subject to any disclaimer, the term of this patent is extended or adjusted under 35 U.S.C. 154(b) by 0 days.

(21) Appl. No.: 10/243,212

(22) Filed: Sep. 13, 2002

(65) Prior Publication Data

US 2004/0050734 A1 Mar. 18, 2004

(51) Int. Cl.[7] ..... B65D 85/28
(52) U.S. Cl. ..... 206/373; 206/378
(58) Field of Search ..... 206/372, 373, 206/376, 377, 378, 1.5, 806, 349, 477, 478, 480, 483

(56) References Cited

U.S. PATENT DOCUMENTS 5,447,232 A * 9/1995 Chow ..... 206/378
5,855,274 A * 1/1999 Piao ..... 206/373
5,918,741 A * 7/1999 Vasudeva ..... 206/376
5,941,386 A * 8/1999 Hu et al. ..... 206/376
6,079,559 A * 6/2000 Lee ..... 206/378
6,241,092 B1 * 6/2001 Vasudeva ..... 206/349
6,367,628 B2 * 4/2002 Hu ..... 206/377
6,378,700 B1 * 4/2002 Tong ..... 206/376
6,401,923 B1 * 6/2002 Huang ..... 206/376

* cited by examiner

*Primary Examiner*—Shian Luong
(74) *Attorney, Agent, or Firm*—William E. Pelton, Esq.

(57) ABSTRACT

A tool suspension device has a back plate and at least one tool bracket. The back plate has a body and at least one tool mounting space formed in the body. Two mounting brackets with mounting slots are respectively formed at opposite sides of each respective tool mounting space. A hole is defined in the body and corresponds to each respective mounting bracket. A resilient arm with a foot is formed on the top end of each respective hole. Each tool bracket is mounted on the back plate and corresponds to one of the tool mounting spaces. The tool bracket has a main plate and two ears corresponding to the mounting slots in the mounting brackets. Accordingly, the tool bracket will not slide out of the bottom of the mounting slots due to the blocking effect provided by the feet.

5 Claims, 7 Drawing Sheets

TOOL SUSPENSION DEVICE

BACKGROUND OF THE INVENTION

1. Field of the Invention

The present invention relates to a tool suspension device, and more particularly to a tool suspension device that provides security and anti-thief features when displaying the tool.

2. Description of Related Art

A suspension device for holding a tool or tools is always used in modern stores where tools are sold or displayed. However, the conventional tool suspension device does not have any anti-thief feature, and tools displayed on conventional tool suspension devices are easily stolen.

To overcome the shortcomings, the present invention tends to provide a tool suspension device to mitigate or obviate the aforementioned problems.

SUMMARY OF THE INVENTION

The main objective of the invention is to provide a tool suspension device that can provide excellent security and anti-thief features and is convenient to assemble. The tool suspension device has a back plate and at least one tool bracket. The back plate has a body and at least one tool mounting space formed on the body. Two mounting brackets are attached to the body respectively at opposite sides of each respective tool mounting space and extend toward each other. A mounting slot is defined between each respective mounting bracket and the body. A hole is defined in the body and corresponds to each respective mounting bracket. A resilient arm is formed on the top end of each respective hole. A foot with a flat bottom is formed on the bottom end of each respective resilient arm. Each tool bracket is mounted on the back-plate and corresponds to one of the tool mounting spaces. The tool bracket has a main plate and two ears corresponding to the mounting slots in the mounting brackets at opposite sides of the corresponding tool mounting space. Accordingly, the tool bracket will not escape from the mounting slots in the mounting brackets due to the blocking effect provided by the feet on the resilient arms. The tools can be securely mounted in the tool mounting space and be held by the tool bracket, such that an excellent anti-thief effect is provided.

Other objects, advantages and novel features of the invention will become more apparent from the following detailed description when taken in conjunction with the accompanying drawings.

DETAILED DESCRIPTION OF THE PREFERRED EMBODIMENT

Figure 1:
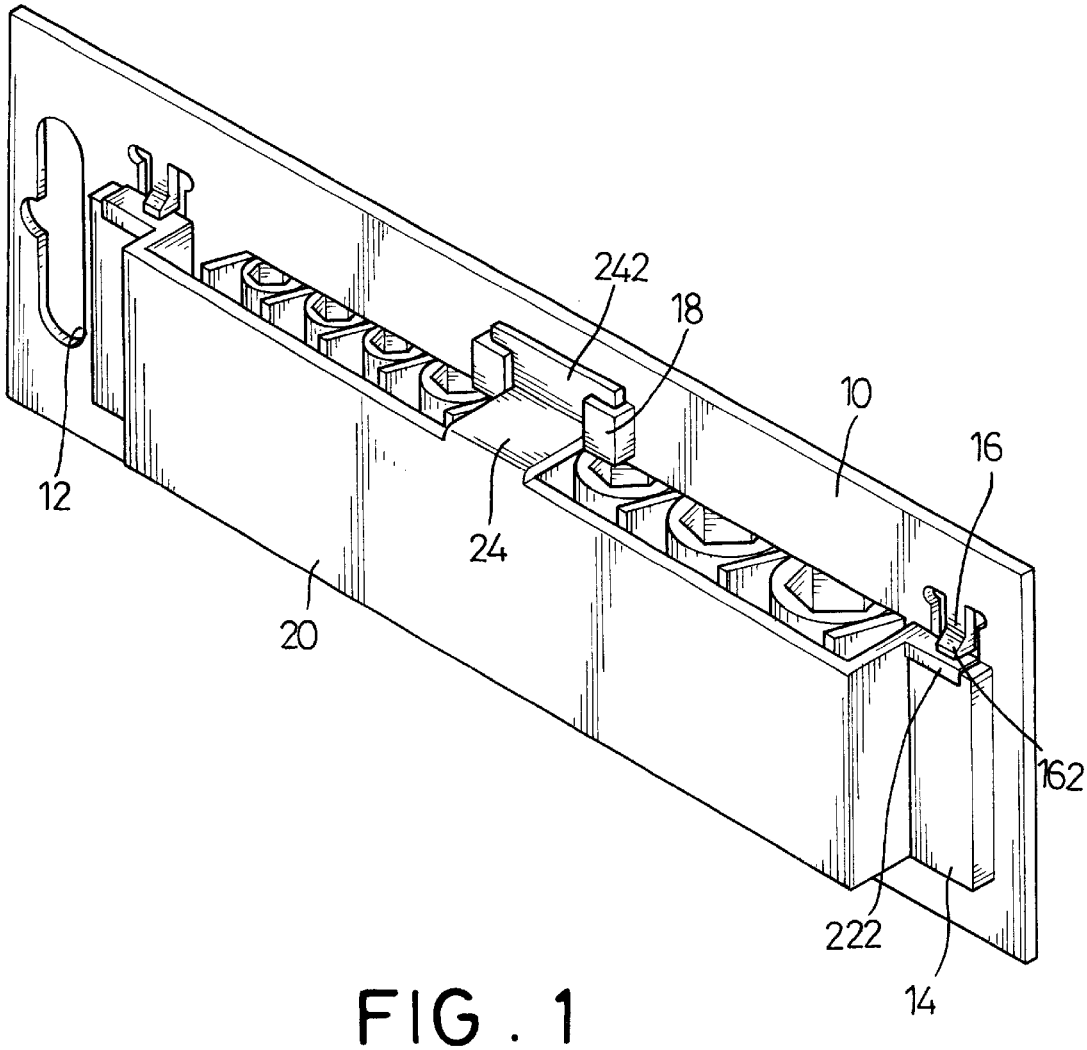
FIG. 1 is a perspective view of a tool suspension device in accordance with the present invention.
Figure 2:
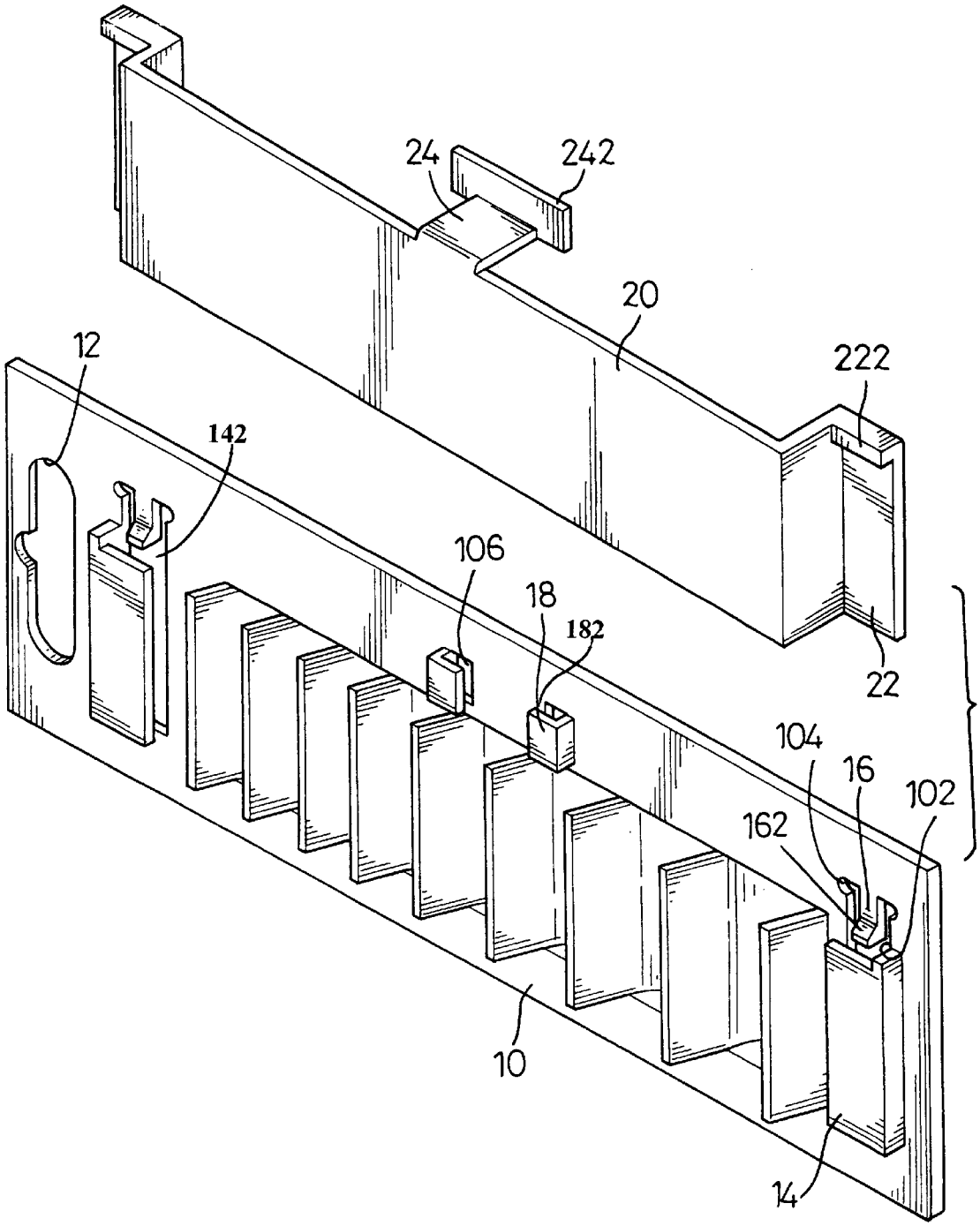
FIG. 2 is an exploded perspective view of the tool suspension device in FIG. 1.
Figure 3:
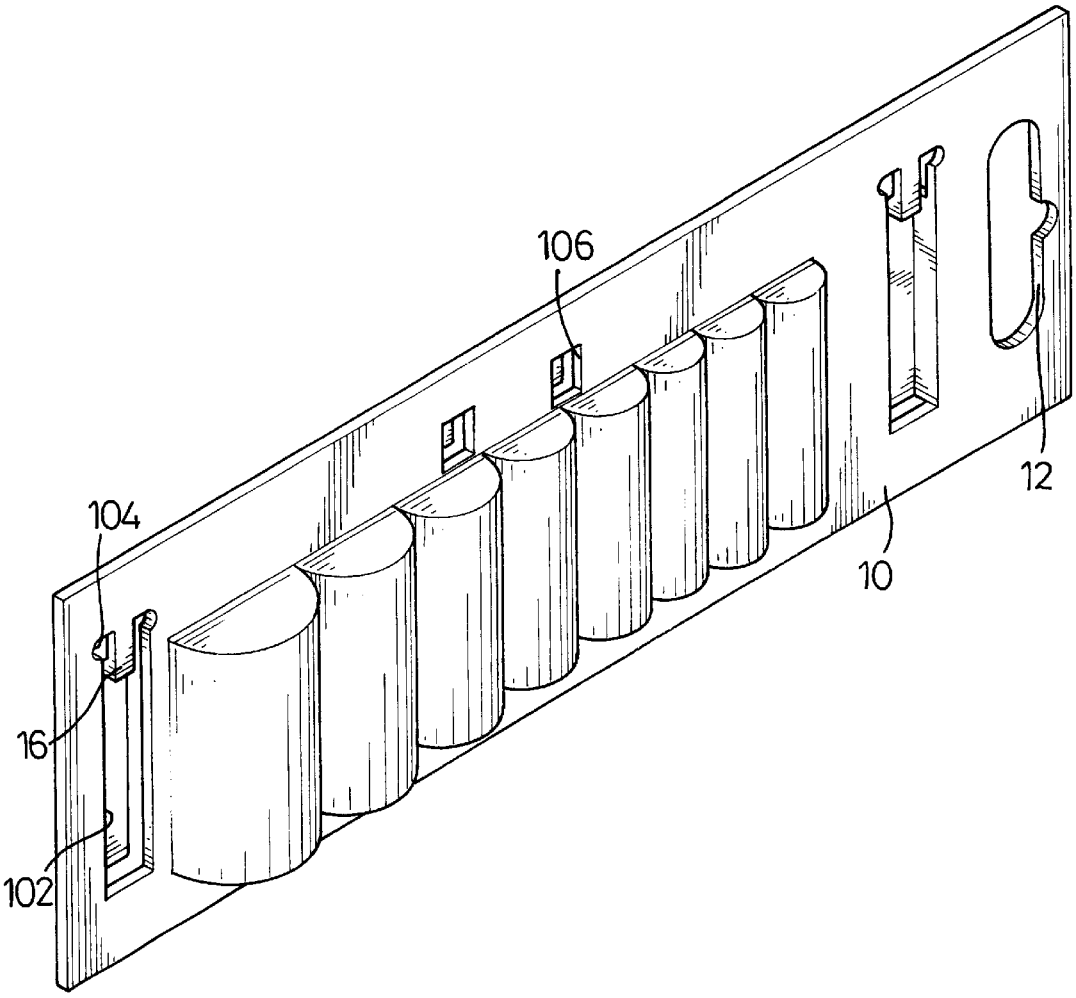
FIG. 3 is a rear perspective view of the tool suspension device in FIG. 1.
Figure 4:
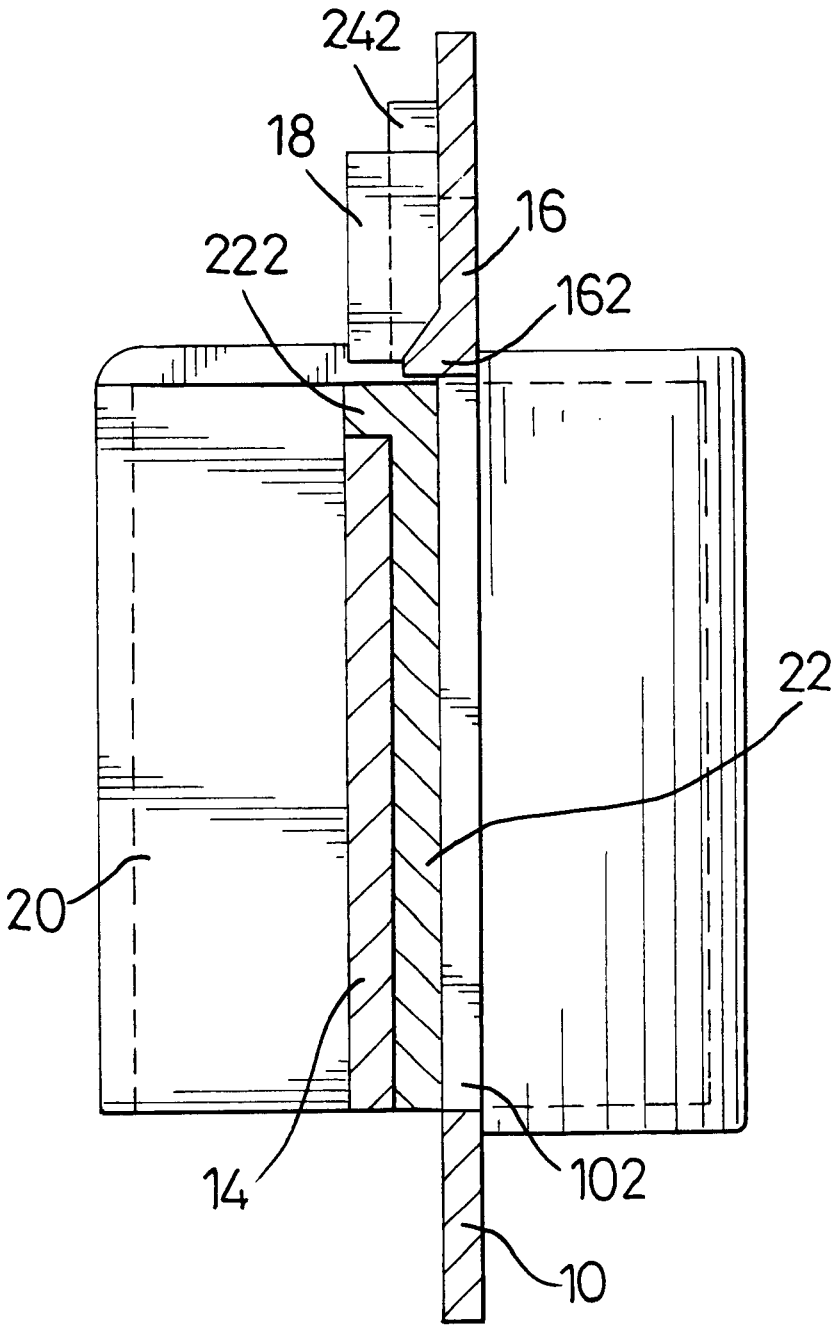
FIG. 4 is a cross sectional side plan view of the tool suspension device in FIG. 1.

With reference to FIGS. 1 to 4, a tool suspension device in accordance with the present invention comprises a back plate (10) and a tool bracket (20). The back plate (10) has a rectangular body. A suspension hole (12) is defined in the body, such that the back plate (10) can be suspended on a wall or a rack by the suspension hole (12). A tool mounting space (not numbered) is formed in the body to hold a tool or tools. In practice, the tool mounting space has multiple cavities defined in the body to hold sockets for a socket wrench. Two lazy-L shaped mounting brackets (14) with a top edge are attached to the body respectively at opposite sides of the tool mounting space, and the two mounting brackets (14) extend toward each other. A mounting slot (142) is defined between each respective mounting bracket (14) and the body. Two holes (102) are defined in the body respectively corresponding to each mounting bracket (14). The holes (102) are essentially rectangular and have a top edge. The top end of each hole (102) is located above the top edge of the corresponding mounting bracket (14). With the arrangement of the holes (102), the structure of a mold to make the back plate (10) is simplified. A resilient arm (16) is formed on the top end of each respective hole (102) and has a bottom end above the top of the corresponding mounting bracket (14). A foot (162) with a flat bottom is formed on the bottom end of each respective resilient arm (16) and extends into the corresponding mounting slot (142). In addition, a notch (104) is defined in each side of the top end of each hole (102).

The tool bracket (20) is mounted on the back plate (10) and corresponds to the tool mounting space, such that the tool bracket (20) can hold a tool or tools between the tool mounting space in the back plate (10) and the tool bracket (20). The tool bracket (20) has a main plate (not numbered) with a mounting space. Two ears (22) with a top edge are respectively formed at opposite sides of the main plate to correspond to the mounting slots (142) between the mounting brackets (14) and the back plate (10) at opposite sides of the tool mounting space. A blocking device is formed at the top edge of each ear (22) to correspond to and abut the top edge of the mounting bracket (14) to keep the ear (22) from sliding through the bottom of the corresponding mounting slot (142). In practice, each blocking device is a lip (222) formed on the top of the ear (22). When the ear (22) is mounted in the corresponding mounting slot (142), the lip (222) will abut the top edge of the corresponding one of the mounting brackets (14). Accordingly, the ear (22) will not slide through the bottom of the mounting slot (142) due to the abutment between the lip (222) and the top of the mounting bracket (14).

When mounting the tool bracket (20) on the back plate (10), the tool bracket (20) is pressed against the back plate (10) and then slid downward along the back plate (10) so the ears (23) slide into the corresponding mounting slots (142). The ears (22) will press the feet (162) on the resilient arms (16) out of the way when the ears (22) slide into the mounting slots (142). The tool bracket (20) moves downward until the lips (222) abut the top edges of the mounting brackets (14), and the feet (162) on the resilient arms (16) respectively clear and abut the top of the lips (222) on the ears (22). Consequently, the tool bracket (20) will not slide up from the top of the mounting slots (142), such that the tool bracket (20) is securely held on the back plate (10). Accordingly, the tools in the tool mounting space can be kept from being removed from the back plate (10), and an anti-thief feature is achieved when the tools are displayed for sale. In addition, because only one step is needed to lock the tool bracket (20) on the back plate (10), assembling the tool suspension device is very easy and convenient. Furthermore, the back plate (10) and the tool bracket (20) are formed as individual pieces by injection molding, and there is no need to produce extra components to lock the pieces together. Therefore, the cost for manufacturing the suspension device is reduced.

After the user buys the tools, the user can cut off the resilient arms (16) with a pair of scissors or the like. Consequently, the tool bracket (20) can be unlocked, and the ears (22) of the tool bracket (20) can be removed from the top of the mounting slots (142). Thus, the user can use the tools mounted in tool mounting space freely. The free ends of the blades of scissors can be pressed into the notches (104), such that it is convenient to cut off the resilient arms (16) with scissors.

Two auxiliary mounting brackets (18) are separately mounted on the body of the back plate (20) above the tool mounting space, and the auxiliary mounting brackets (18) extends toward each other. A mounting slot (182) is defined between each respective auxiliary mounting bracket (18) and the body. A hole (106) is defined in the body and corresponds to each respective auxiliary mounting bracket (18) so as to simplify the mold for forming the back plate (10) with the auxiliary mounting brackets (18).

An extension (24) laterally extends from the top of the main plate of the tool bracket (20). A tab (242) is vertically formed on the extension (24) and has two ends respectively corresponding to the mounting slots (182) in the auxiliary mounting brackets (18). When the ears (22) of the tool bracket (20) are in the mounting slots (142) in the corresponding mounting brackets (14), two ends of the tab (242) will be in the mounting slots (182) in the auxiliary mounting brackets (18). With the engagement between the tab (242) and the auxiliary mounting brackets (18), the main plate will not be pulled out from the back plate (20) at the middle of the main plate. This provide a further improved security and anti-thief effect to the tools in the tool mounting space.

Figure 5:
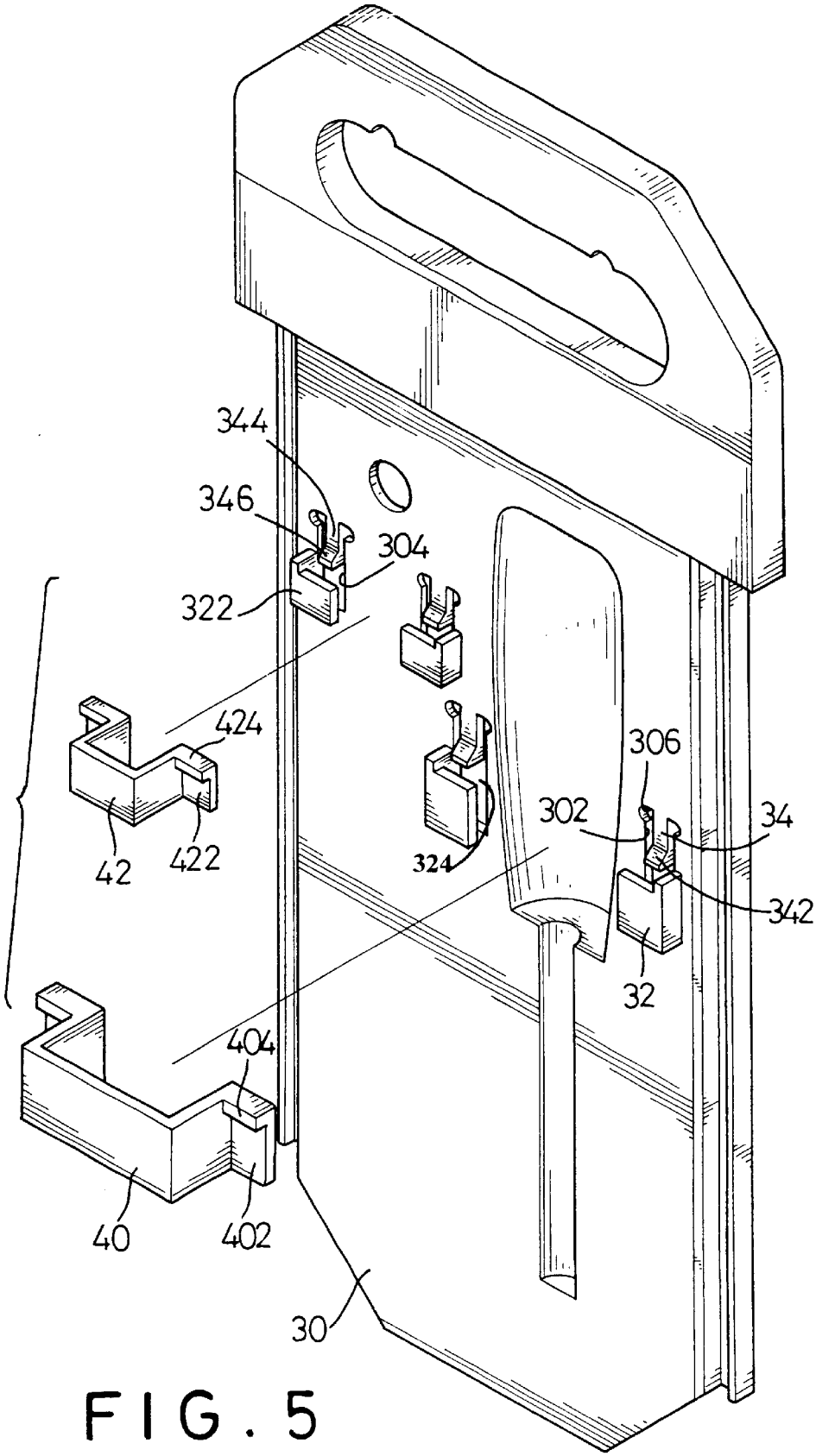
FIG. 5 is an exploded perspective view of a second embodiment of a tool suspension device in accordance with the present invention.

With reference to FIG. 5, two tool mounting spaces are formed on the back plate (30) to respectively hold different tools. Two mounting brackets (32, 322) with mounting slots (324) are attached to the body and are respectively at two sides of each tool mounting space. Holes (302, 304) respectively having a top are defined in the body and respectively correspond to each mounting bracket (32, 322). Resilient arms (34,344), each with a bottom end, are formed respectively on the top of each hole (302, 304), and a foot (342, 346) with a flat bottom is formed on the bottom end of each resilient arm (34, 344). A notch (306) is defined in each side of the top end of each hole (302, 304).

Two tool brackets (40, 42) are mounted on the back plate (30) and respectively correspond to the tool mounting spaces. Each tool bracket (40, 42) has a main plate and two ears (402, 422) formed at opposite sides of the main plate to correspond to the mounting slots (324) in the mounting brackets (32, 322) at opposite sides of the corresponding tool mounting space. A lip (404, 424) is formed on the top of each ear (402, 422) to abut the top of the corresponding mounting bracket (32, 322) when the ear (402, 422) is mounted in the corresponding mounting slot (324). Consequently, two different tools can be securely mounted in the tool mounting spaces and held by the tool brackets (40, 42).

Figure 6:
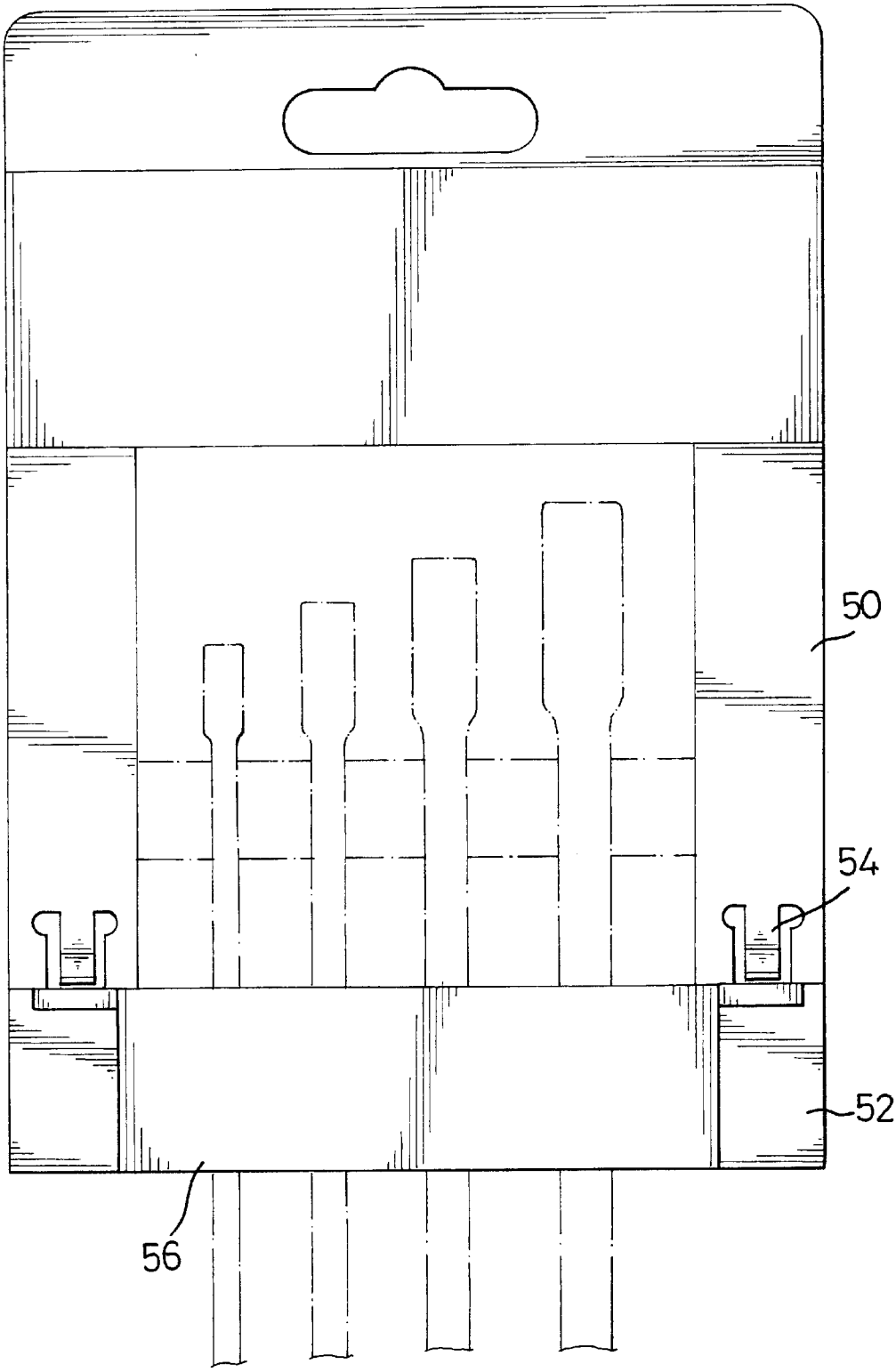
FIG. 6 is a front plan view a third embodiment of a tool suspension device in accordance with the present invention.
Figure 7:
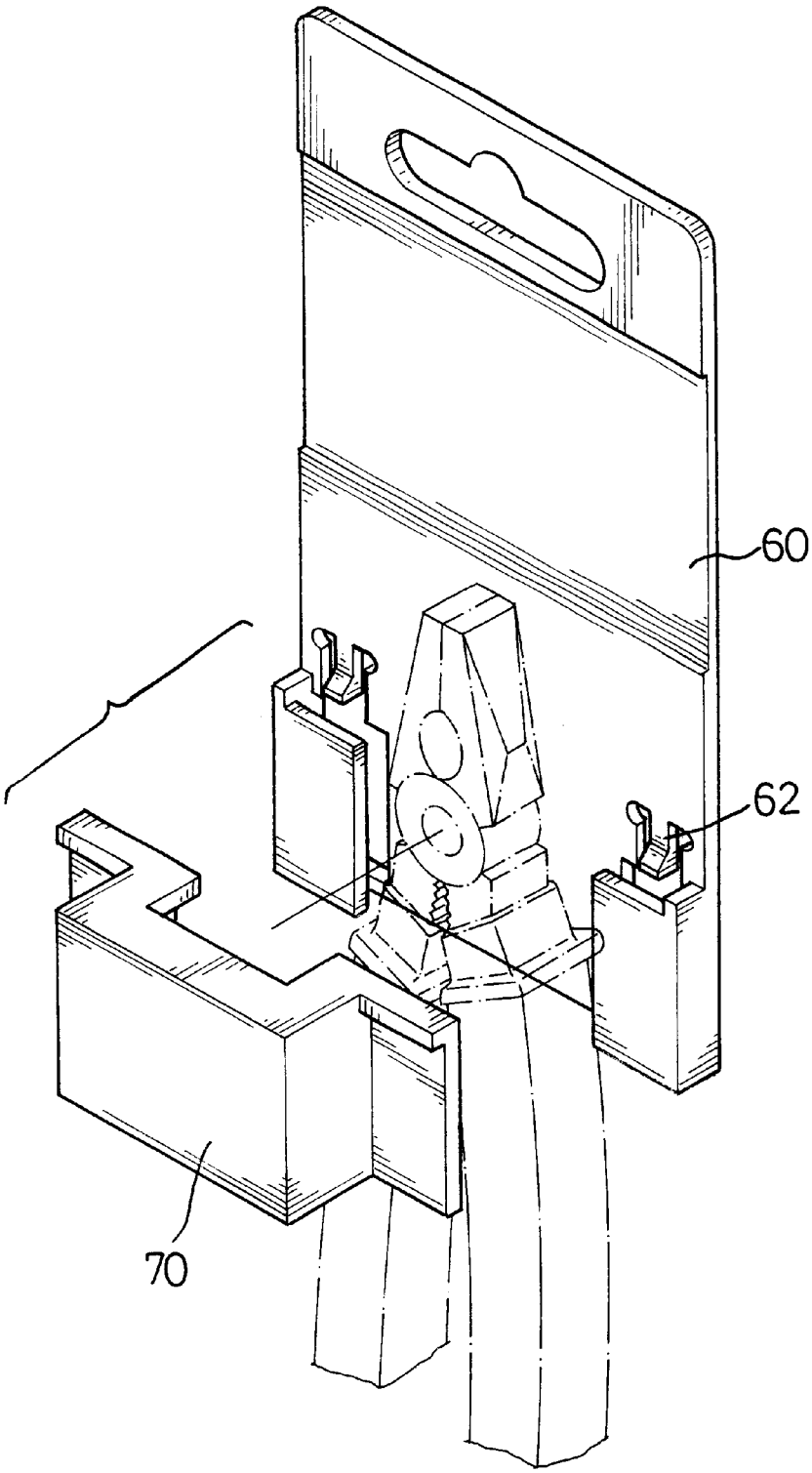
FIG. 7 is an exploded perspective view of a fourth embodiment of a tool suspension device in accordance with the present invention.

With reference to FIG. 6, the suspension device can be used to securely hold a whole set of wrenches between the back plate (50) and the tool bracket (56) with the abutment of the resilient arms (54) and ears (52). With reference to FIG. 7, another embodiment of the suspension device can be used to securely hold a single tool such as a pair of pliers between the back plate (60) and the tool bracket (70) with the abutment of the resilient arms (62) and ears.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A tool suspension device adapted to hold a tool, and comprising:

a back plate having:
- a body;
- a suspension hole defined in the body;
- at least one tool mounting space formed in the body adapted to hold tool;
- two mounting brackets attached to the body respectively at opposite sides of each one of the at least one tool mounting space and extending toward each other;
- a mounting slot defined between each mounting bracket and the body;
- a first hole defined in the body and corresponding to each mounting bracket and having a top end above a top of the corresponding mounting bracket;
- a resilient arm formed on the top end of each respective first hole and having a bottom end; and
- a foot with a flat bottom formed on the bottom end of each respective resilient arm; and a tool bracket mounted on the back plate and corresponding to each one of the at least one tool mounting space, the tool bracket having:
- a main plate with a mounting space defined in the main plate and corresponding to the tool mounting space; and
- two ears respectively formed at opposite sides of each respective main plate to correspond to the mounting slots in the mounting brackets at opposite sides of the corresponding tool mounting space,
- wherein a blocking device is formed between each respective ear and the corresponding one of the mounting brackets to keep the ear from sliding through a bottom of the corresponding one of the mounting slots.

2. The tool suspension device as claimed in claim 1 further comprising a notch defined in each side of the top end of each respective hole.

3. The tool suspension device as claimed in claim 1 further comprising two auxiliary mounting brackets separately mounted on the body of the back plate and above each tool mounting space and extending toward each other, a mounting slot defined between each respective auxiliary mounting bracket and the body;

an extension laterally extending from a top of the main plate of each respective tool bracket; and a tab vertically formed on the extension of each respective tool bracket and having two ends respectively received in the mounting slots in the auxiliary mounting brackets above the corresponding tool mounting space when the ears of the tool bracket are in the mounting slots in the corresponding mounting brackets.

4. The tool suspension device as claimed in claim 1 further comprising a hole defined in the body and corresponding to each respective auxiliary mounting bracket.

5. The tool suspension device as claimed in claim 1, wherein each blocking device is a lip formed on a top of each respective ear to abut the top of the corresponding mounting bracket and to be blocked by the flat bottom of the foot on the corresponding resilient arm when the ears are mounted in the corresponding mounting slots.

* * * * *